United States Patent [19]

Matarese et al.

[11] Patent Number: 4,744,725

[45] Date of Patent: May 17, 1988

[54] ABRASIVE SURFACED ARTICLE FOR HIGH TEMPERATURE SERVICE

[75] Inventors: Alfred P. Matarese, North Haven; Harry E. Eaton, Woodstock; Richard C. Novak, Glastonbury; James M. Goodman, Ellington, all of Conn.

[73] Assignee: United Technologies Corporation, Hartford, Conn.

[21] Appl. No.: 624,421

[22] Filed: Jun. 25, 1984

[51] Int. Cl.[4] ..... F01D 5/20; F04D 29/08

[52] U.S. Cl. ..... 415/172 A; 415/174; 428/143; 428/206; 428/208; 428/323; 428/325; 428/698

[58] Field of Search ..... 415/172 A, 173 R, 174; 416/241 B; 428/325, 143, 206, 208, 698

[56] References Cited

U.S. PATENT DOCUMENTS

| | | | |
|---|---|---|---|
| 3,248,189 | 4/1966 | Harris, Jr. | 51/295 |
| 3,377,264 | 4/1968 | Duke et al. | 204/290 |
| 3,508,890 | 4/1970 | Fontanella | 51/295 |
| 3,615,309 | 10/1971 | Dawson | 51/309 |
| 3,676,208 | 7/1972 | Griffin | 428/325 |
| 3,779,726 | 12/1973 | Fisk et al. | 51/295 |
| 3,801,353 | 4/1974 | Brill-Edwards | 416/241 R |
| 3,841,885 | 10/1974 | Zalis | 416/241 R |
| 3,871,840 | 3/1975 | Wilder et al. | 51/295 |
| 3,920,410 | 11/1975 | Kunda et al. | 29/192 R |
| 3,922,207 | 11/1975 | Lowrey, Jr. et al. | 204/26 |
| 3,922,433 | 11/1975 | Patterson et al. | 428/325 |
| 3,963,449 | 6/1976 | Seki et al. | 428/325 |
| 3,975,165 | 8/1976 | Elbert et al. | 29/182.2 |
| 4,029,852 | 6/1977 | Palena | 428/621 |
| 4,148,494 | 4/1979 | Zelahy et al. | 415/172 A |
| 4,169,020 | 9/1979 | Stalker et al. | 204/23 |
| 4,232,995 | 11/1980 | Stalker et al. | 416/241 R |
| 4,249,913 | 2/1981 | Johnson et al. | 416/241 R |
| 4,268,564 | 5/1981 | Narisimhan | 428/143 |
| 4,269,903 | 5/1981 | Clingman et al. | 428/591 |
| 4,291,089 | 9/1981 | Adamovic | 428/325 |
| 4,374,173 | 2/1983 | Adamovic | 428/325 |
| 4,386,112 | 5/1983 | Eaton et al. | 427/34 |
| 4,418,124 | 11/1983 | Jackson et al. | 416/241 R |
| 4,434,202 | 2/1984 | Uedaira et al. | 428/143 |

*Primary Examiner*—George F. Lesmes
*Assistant Examiner*—William M. Atkinson
*Attorney, Agent, or Firm*—C. G. Nessler; James M. Rashid

[57] ABSTRACT

A very thin abrasive material on a substrate is comprised of ceramic particulates contained within a metal matrix. The particulates extend fully through the matrix from the substrate surface to the machined free surface of the abrasive. In a representative 0.38 mm abrasive the particulates are sized normally at 0.42–0.50 mm and have an aspect ratio of less than 1.9 to 1. This enables a high density of particulates, in the range 33–62 per $cm^2$, while at the same time ensuring good bonding in that most of the particulates are fully surrounded by matrix. When the abrasive is applied to the tip of a superalloy gas turbine engine blade, about 10–50% of the matrix metal is removed after machining. This allows the machined ceramic particulates to project into space and to thus better interact with ceramic abradable seals. In the preferred practice of the invention the particulates are alumina coated silicon carbide contained in a nickel superalloy matrix.

16 Claims, 2 Drawing Sheets

FIG. 1
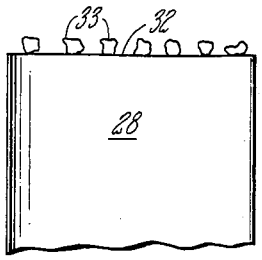
FIG. 2
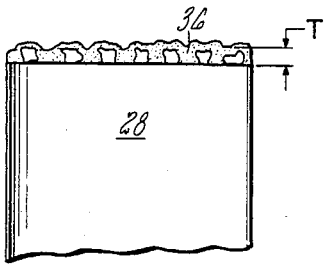
FIG. 3
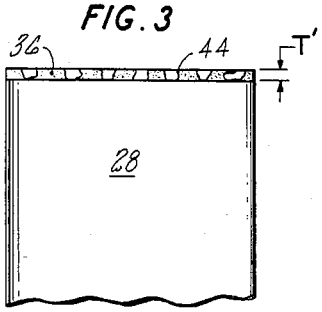
FIG. 4
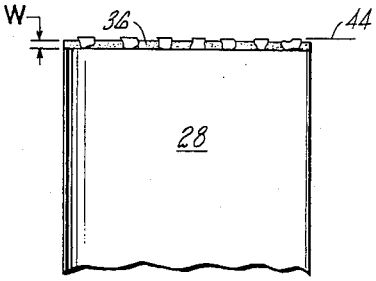
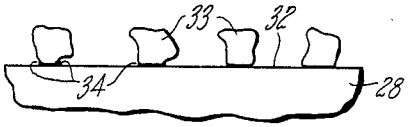
FIG. 5
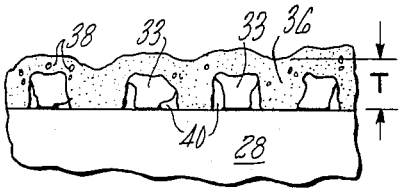
FIG. 6
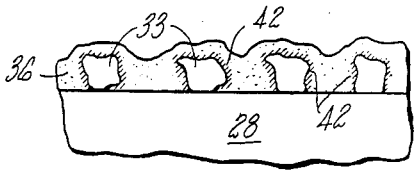
FIG. 7

FIG. 8
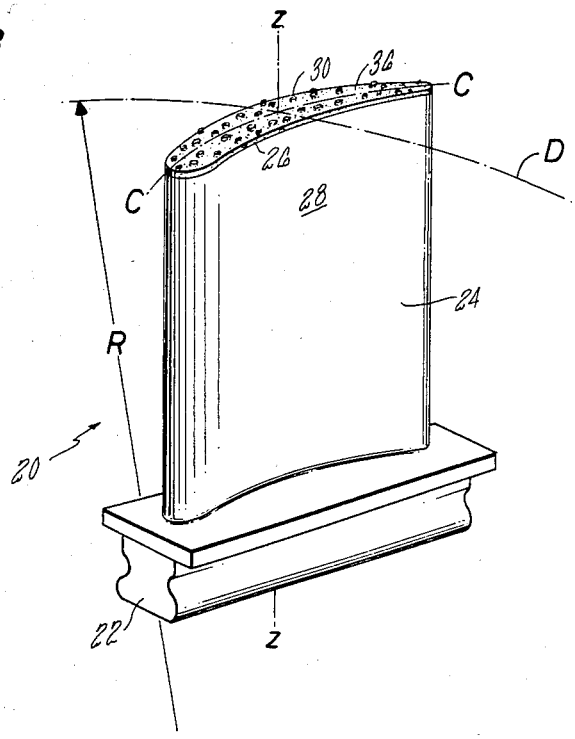
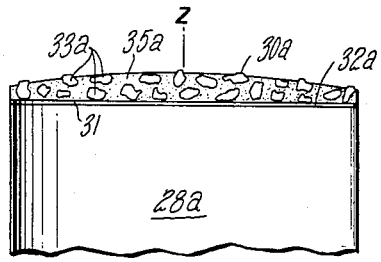
FIG. 9 PRIOR ART
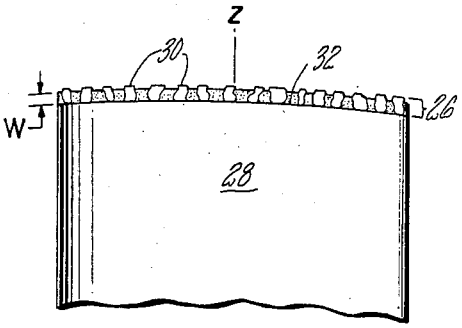
FIG. 10

ABRASIVE SURFACED ARTICLE FOR HIGH TEMPERATURE SERVICE

TECHNICAL FIELD

The present invention relates to abrasives, particularly thin layer abrasives applied to superalloys which are used at elevated temperatures.

BACKGROUND

Gas turbine engines and other axial flow turbomachines have rows of rotating blades contained within a generally cylindrical case. It is very desirable to minimize the leakage of the gas or other working fluid around the tips of the blades there they come close to the case. As has been known for some time, this leakage is minimized by blade and sealing systems in which the blade tips rub against a seal attached to the interior of the engine case. Generally, the blade tip is made to be harder and more abrasive than the seal; thus, the blade tips will cut into the seal during those parts of engine operation when they come into contact with each other.

In the earlier systems of the type just described the blade tip was a superalloy material, possibly even having a hard face, and the seal was a metal which had a suitable propensity for wear. For instance, porous powder metals were used. Now however, ceramic containing seals are finding favor, such as those shown in U.S. Pat. No. 3,975,165 to Elbert et al, U.S. Pat. No. 4,269,903 to Klingman et al and U.S. Pat. No. 4,273,824 to McComas et al. The ceramic faced seals are considerably harder than the prior art metal seals and as a result, the prior art blade tips were deficient in being able to wear away the seal with little wear to themselves.

Consequently, there have been developed improved blade tips, most particularly of the type described in U.S. Pat. No. 4,249,913 to Johnson et al "Alumina Coated Silicon Carbide Abrasive" of common ownership herewith. In the Johnson et al invention silicon carbide particulate of 0.20–0.76 mm average nominal diameter is coated with a metal oxide such as alumina and incorporated by powder metal or casting techniques in nickel or cobalt base alloys. A powder metal compact containing 30–45 volume percent particulate may be made and this part is then bonded, such as by diffusion bonding, liquid phase bonding or brazing to the tip of a blade.

However, there are certain inherent characteristics of an abrasive tip made by the foregoing technique. Specifically, the metal part can only be made in a practical minimum thickness, typically of the order of 1–2 mm thick. Usually, the abrasive tip part is made in the cross sectional shape of the tip of the turbine blade substrate. After being compacted or cast it is machined to a flat surface. Likewise, the blade tip is machined to a planar surface to receive the abrasive. Such planar machining is a practical limitation necessary to get good faying fit and minimum weld joint thickness, of the order of 0.05 mm. Unless this is done adequate bond strength in the 1100° C. operating temperature range will not be attained. After bonding of the abrasive on a blade tip, a multiplicity of blades are assembled in a fixture which is adapted to rotate much like the disc of the engine in which they are used. They are then ground to a cylindrical or conical surface which corresponds with the interior surface of the engine case seals. As a result of this procedure, the abrasive will initially have a substantial thickness which will have to be ground to a substantial degree. The particulates are often costly and thus the approach is costly. Second, because practicality dictates a planar joint surface and because the final finished surface of the abrasive tipped blade will be cylindrical or conical, there will be a varying thickness of abrasive across the blade tip, as shown in FIG. 9 herein. While the prior art blade tips are useful, it is more desirable that the abrasive portion of the tip be uniform in thickness across the curved surface. It is also very desirable to minimize the quantity of grits which must be used in the manufacturing process since they must be of the highest quality and their manufacture, including the oxide coating process, is expensive.

An object of the present invention is to provide on the tip of the blade a thin and uniform layer of abrasive coating adapted for use in the vicinity of 1100° C. and higher. Thin layers of particulate-bearing abrasive, although not adapted to operate at such high temperatures, have been known. For example, coated abrasives made from alumina, silica and silicon carbide are common products, as are metal bonded diamond and cubic boron nitride grinding wheels. Fused and unfused layers of sprayed metal are well known in the metallizing field. See for example U.S. Pat. No. 3,248,189 to Harris, Jr. and U.S. Pat. No. 4,386,112 of Eaton and Novak, the present applicants. However, any process of metal spraying grits and matrix metal is inherently inefficient in that only a fraction of the sprayed material actually hits and adheres to the surface. These difficulties are especially significant in light of the relatively small size, e.g., about 6 by 50 mm, of a typical turbine blade tip.

Of particular interest in the context of the present invention is the following art. Silicon carbide particles are bonded to a fabric using an organic binder and then overcoated with aluminum, and other metals, according to Fontanella U.S. Pat. No. 3,508,890 and Duke et al U.S. Pat. No. 3,377,264. Fisk et al in U.S. Pat. No. 3,779,726 describe a method of making metal-abrasive tools containing silicon carbide and other grits which comprises encapsulating grit in a porous metal coating and then impregnating the encapsulating layer with other metal to unite the particles. Palena in U.S. Pat. No. 4,029,852 describes how a non-skid surface is made by laying grits on a surface and spraying molten metal droplets over them. The Palena invention involves a relatively crude product, such as a stairway tread, in contrast to the finer product which characterizes metal bonded abrasives and the invention herein. Wilder in U.S. Pat. No. 3,871,840 describes how encapsulating grits in a pure metal envelope improves the properties of a metal bonded abrasive made in various ways.

The aforementioned abrasive comprised of a previously fabricated particulate and metal structure, attached by a welding process to a turbine blade tip, has shown the characteristics of the abrasive which are useful. But while it is desirable that the thickness of the abrasive be reduced to the minimum necessary for a durable tip, such minimum cannot be attained with the bonded abrasive tip part because of practical manufacturing problems mentioned above. At the same time, it is known from past experience that the commonly available material systems associated with less exotic applications, some of which are described in the aforementioned patents, are not sufficiently durable even though they would appear capable of providing the desired minimum thickness. Therefore, it was necessary to conduct research and development to produce a superalloy turbine blade which had the desired abrasive tip.

DISCLOSURE OF THE INVENTION

An object of the invention is to provide a thin layer abrasive on the surface of metal objects. In particular, an object of the invention is to provide on an airfoil for use in turbomachinery an abrasive material which is very light yet durable. Thus, it is desired to make the abrasive of ceramic particulates and metal, where as few particulates as possible are used. For high temperature use, the abrasive must be comprised of oxidation resistant materials, particularly a superalloy matrix metal, and the abrasive be well bonded to a superalloy substrate to resist thermal and mechanical stresses.

According to the invention, an article will have but a single layer of ceramic particulate on its surface. The particulates will be in contact with the surface of the substrate and will predominately extend through a surrounding matrix metal to a free machined surface. And when the machined surface is parallel to the surface on which the abrasive is laid, the particulates will thus have equal lengths and will be disposed at the surface in a most effective manner. To obtain the optimum performance from the abrasive the particulates are closely but evenly spaced. But they are carefully sized and placed so that at least 80 percent do not touch one another. Thus, the presence of surrounding matrix means that the particulates are well bonded into the abrasive and that the abrasive is well bonded to the substrate. The inventive abrasives are made from ceramics which have particulate aspect ratios less than 1.9 to 1, preferably in the vicinity of 1.5 to 1. This enables particulates to be present with generally uniform spacing at densities of 33–62 particulates per $cm^2$ of article surface, preferably 42–53, and with 10–20 volume percent ceramic.

In the preferred practice of the invention the abrasive material is applied to the tip of a superalloy turbine blade using sintering, plasma arc spraying and machining. The ceramic particulates are those which do not interact with the matrix material at elevated temperature. For example, alumina coated silicon carbide particulates are used. The particulates are further clad with a sinterable material, such as nickel. The particulates are laid on the surface and heated to a sintering temperature to thereby cause the nickel layer to metallically adhere to the substrate. Then, a superalloy matrix material is deposited over the particulates, usually by means of a "line of sight" process (the deposited metal travels in a straight line toward the surface). There are voids created in the vicinity of the irregular shaped particulates laying on the surface and subsequent processing, such as hot isostatic pressing, is used to densify the matrix around the particulates. This results in a metallurgical structure characterized by a dense superalloy matrix containing ceramic particulates having a region of interdiffused metal around them, which region is relatively depleted in the constituents of the matrix material and relatively rich in the constituent of the cladding material.

When the abrasive is on the tip of a blade which interacts with a ceramic seal, the matrix material is partially removed from the free machined surface of the abrasive, to expose 10–50 percent of the particulate length as measured from the substrate. This improves the ability of the abrasive to cut ceramic seals.

The invention is effective in providing on a relatively small cambered surface of an airfoil tip an abrasive material which is effective in protecting the blade tip from wear, cutting into ceramic abradable seals, resisting high temperatures and thermal stresses and otherwise achieving the objects of the invention.

The foregoing and other objects, features and advantages of the present invention will become more apparent from the following description of preferred embodiments and accompanying drawings.

BRIEF DESCRIPTION OF DRAWINGS

FIGS. 1–4 show schematically the sequential steps by which particulates are placed on the surface of a substrate, enveloped in matrix, machined to a flat surface, and machined to a final configuration.

FIG. 5 is a more detailed view of a portion of FIG. 1 showing how particulates appear after they have been metallically adhered to the surface of the substrate.

FIG. 6 is a more detailed view of a portion of FIG. 2 showing how the matrix envelops particulates and includes porosity when a "line of sight" deposition procedure is used.

FIG. 7 is a more detailed view of a portion of FIG. 2 showing how the structure in FIG. 6 is transformed after high temperature pressing to eliminate voids and cause interdiffusion.

FIG. 8 shows generally a typical gas turbine blade having an abrasive layer on its tip.

FIG. 9 shows in side view the appearance of a prior art abrasive blade tip, illustrating the varying thickness and bond joint.

FIG. 10 is a side view of the blade in FIG. 8, along line D, showing how particulates are present in a single layer and how they extend slightly above the matrix material of the abrasive.

BEST MODE FOR CARRYING OUT THE INVENTION

The invention is described in terms of the bonding of a silicon carbide particulate and superalloy matrix abrasive material, called simply an "abrasive" herein, onto the tip of a typical advanced gas turbine engine turbine blade made of a single crystal nickel alloy, described in U.S. Pat. No. 4,209,348. Alumina coated silicon carbide particulates of the type disclosed in U.S. Pat. No. 4,249,913 to Johnson et al are preferably used in the invention. The disclosure of both the foregoing patents, commonly owned herewith, are hereby incorporated by reference. The invention will be applicable to other materials as well. As the Johnson et al patent indicates, an alumina coating on silicon carbide particulate is particularly useful because it prevents interaction between the silicon carbide and the surrounding matrix metal. Such interaction can occur during fabrication and during high temperature use, and can degrade the ability of the silicon carbide particulate to perform the abrasive function. Preferably, the alumina coating is 0.010–0.020 mm thick and is applied by a commercial chemical vapor deposition process.

The matrix is a metal which is able to be bonded to the particulates and the substrate. The matrix in the best mode of the present invention is either a high temperature alloy, meaning an alloy adapted for use at a temperature of 600° C. or higher such as the commercial alloys Inconel 600, Inconel 625, Hastelloy X, Haynes 188 and MCrAlY, or a superalloy, meaning an alloy based on Ni, Co or Fe such as commercial nickel base alloys Waspaloy, IN 100, U 700, MAR-M200, Inconel 718 which are strengthened by a gamma prime precipitate.

Alloys of either type tend to have a number of constituents of varying nature, e.g., Ni, Co, Fe, Cr and Al with either of the latter two elements particularly characterizing them, to provide oxidation resistance.

Preferably, the superalloy matrix has the nominal composition by weight percent of 21–25 Cr, 4.5–7 Al, 4–10 W, 2.5–7 Ta, 0.02–0.15 Y, 0.1–0.3 C, balance Ni. Another useful material is the cobalt base alloy having the nominal composition by weight percent of 18–30 Cr, 10–30 Ni+Fe, 5–15 W+Mo, 1–5 Ta+Cb, 0.05–0.6 C, 3.5–80 Al, 0.5–20 Hf and 0.02–0.1 Y, balance cobalt.

The configuration of the typical turbine blade is shown in FIG. 8. The blade 20 is comprised of a root part 22 and an airfoil part 24. There is an abrasive layer 26 at the tip end 28 of the blade, the abrasive having been applied by the method of the present invention. The surface 30 of the abrasive tip has been finished to a cylindrical surface of revolution having a nominal radius R and circumference D. The radius R is the radius of the bladed turbine wheel in which the blades typically mount and is also nominally the radius of the inside diameter of the engine case in which the bladed turbine wheel is contained. As a matter of definition the z axis of the blade is that which corresponds with the radial direction. The tip of the blade has a mean camber line C which is the nominal center. line of the airfoil tip cross section. The FIGS. 9 and 10 show a side view of the blade tip, as it appears looking along the line D toward the line C when the line C and the section have been unrolled into a z plane. FIG. 10 shows the appearance of the constant thickness layer 26 of FIG. 8. The uppermost surface 32 of the blade substrate 28 and the surface 30 of the abrasive both describe curvical surfaces. These curves are complex when rolled out, owing to the surface defined by the interaction of the camber shape and the cylindrical surface. The analogous view of a prior art blade tip, constructed in the manner described in the Background, is shown in FIG. 9. While the outermost surface **30*a* of the abrasive is the same as the curvical surface 30 shown in FIG. 10 the surface 32*a* of the blade substrate 28*a* is planar. Thus, the thickness of the abrasive in the radial or z axis direction varies across the camber length C of the airfoil. And there is a pronounced tendency for metal lacking grits to be present at the leading and trailing edges. It is also seen that in the invention of FIG. 10 the abrasive is comprised of a single layer of particulate whereas in the prior art there are of necessity a multiplicity of grits near the center portion 35*a* of the camber line length. Also the prior art abrasive typically has a bond joint 31**.

The process steps for making the thin abrasive tip are in part schematically illustrated by FIGS. 1–7 and are discussed further below. FIGS. 1–4 show in profile the tip of a gas turbine blade while FIGS. 5–7 show a portion of the tip in more detail, all viewed along the line D.

The abrasive tip of the present invention is intended to interact with a ceramic abradable seal, as disclosed diversely in the U.S. patents mentioned in the Background. There are several unique aspects of the abrasive which have been discovered as necessary for good performance and which are different from the prior art tip abrasives. These include the composition of particulates and matrix; the sizing of the particulates, and density with which they are placed on the tip of the blade (both with respect to spacing and volume percent when included in a matrix material); the overall thickness of the abrasive layer; and, the degree to which the particulates are actually enveloped by and disposed in the matrix material. The parametric limitations recited herein are specifically the result of experience with an abrasive which includes a superalloy matrix and alumina coated silicon carbide particulates taught by the Johnson et al patent. However, it will be appreciated that many of the aspects will be pertinent to other particulates as well, particularly those which relate to the mechanical aspects.

The thickness of the abrasive must be limited and in accord with the sizing of the particulates. First, the abrasive contains a single layer of particulates as shown in FIG. 10. A single layer of abrasive particulate is important in order to keep the mass of abrasive material at the tip at a minimum. Substantial centripetal force on the bond between the abrasive and the substrate of the tip results during operation. As the process details herein will make clear, the particulates will contact the substrate tip (or any incidental coating thereon). And, the overall thickness W of the metal matrix must be sufficiently small so that the ceramic particles in the finished abrasive project into space. For it has been found that when abrasives interact with ceramic seals there must be a portion of the particulate extending from the matrix metal, to interact with and cut into the ceramic. When this is not done, some of the matrix metal will be transferred to the ceramic abradable seal material and thus make it less abradable. When the ceramic is made less abradable the wear rate of the blade tip increases.

For the 0.38 mm nominal thickness layer shown in FIG. 3, about 0.15 mm of matrix material, or about 40%, is removed. Empirical tests and calculations show that about 10–50% of matrix must be removed to provide an effective abrasive tip when it interacts with a ceramic seal, in that the particulates will cut properly but at the same time will not be readily removed from the blade tip. A greater amount of removal will leave insufficient matrix to retain the particulates under the load they sustain during use.

The z axis thickness of our preferred tip abrasive is of about 0.38±0.03 mm and for such a thickness the particulates' size will be that which corresponds with sieving between U.S. Sieve Series No. 35–40 (nominally 0.42–0.50 mm). Of course common sieving yields a distribution of particle sizes, especially since typical ceramic particulate is irregular. Some of the particulates will be smaller than No. 40 Sieve size. But, the nominal minimum dimension of the particulates will be 0.42 mm, and such reflects the fact that the preponderance, e.g., 80 percent or more of the ceramics will necessarily extend through the matrix to the free surface 44, 30 of the abrasive as shown in FIGS. 3, 4 and 9. This is in contrast with the prior art shown in FIG. 9 or in the patents previously referred to. When thicker abrasive layers are desired, it will be found useful to employ larger particulates, e.g., up to U.S. Sieve No. 20 (0.83 mm), to achieve the desired results.

Typically, the matrix is applied in sufficient thickness to envelop the particulates, and then the combination is machined to a finish dimension. Thus the preponderance of the particulates will have machined lengths, and when the free surface is parallel to the substrate surface as is usually desirable, the lengths will be equal.

In the best practice of the invention the particulate is evenly but relatively densely spaced. The density will be in the range 33–62 particulates per $cm^2$. Yet, no more than 15–20% of the particulates by number must be agglomerated, i.e., in contact with one another. Spacing between the particulates is needed so they will be adequately enveloped by matrix and adequately adhered in the abrasive. In the invention the particulates are preponderently surrounded entirely by matrix metal in the directions parallel to the surface (i.e., transverse to the z axis). By this is meant that at least 80 percent, typically 90 percent, of the particulates will be surrounded by matrix, excluding of course those exposed by finishing of the side edges of the tip.

To achieve the foregoing combination of higher densities and entirety of envelopment, we have discovered that the hot pressed silicon carbide particulate also must have an aspect ratio of less than 1.9:1, preferably about 1.4–1.5 to 1. The aspect ratio is the nominal ratio of the longest axis of a particulate to its nominal cross section dimension. We measure aspect ratio by use of a Quantimet Surface Analyzer (Cambridge Instruments Ltd., Cambridge, England). This aspect ratio contrasts with ordinary particulate having an aspect ratio of 1.9–2.1 to 1, as was used in the prior art pressed powder metal abrasive tip. With such particulate, excess agglomeration occurred because when it is laid on the surface in the method of making the invention as shown in FIG. 1 it will naturally lie with its longer length generally parallel with the surface. Such high aspect ratio particulates also tend to be less likely to project to the desired height, compared to more equiaxed particulates and inhibit the attainment of high density.

As mentioned, the particulates are enveloped in metal matrix. When the abrasive is machined to an even surface as shown in FIG. 3, prior to removal of the part of the matrix, then the particulates will typically comprise about 10–20, preferably 15 volume percent of the total abrasive. This is less concentration than that taught in the Johnson et al patent. Concentrations above about 20 percent are now found to tend to cause abrasive material failure due to cracking; concentrations less than 10 percent will tend to produce inadequate abrasive properties.

The aforementioned critical sizes, aspect ratios and densities must be attained in order to obtain the desired cutting action. Since a typical tip of a turbine blade is narrow, there will be very few particulates in this region. An object of the invention is to have a full line of particulates across the width of the blade as it is viewed approaching along the line D in FIG. 8. With the abrasive features mentioned this will be obtained in about 90 percent of the blades. The remainder may have a few open spaces due to loss of particulates from the time of first placement on the part up to the time the part is made ready for use.

FIG. 1 shows in side view how the particulates 33 are first laid on the surface 32 of the substrate 28 where they will be subsequently permanently adhered. Prior to placing the silicon carbide particulates on the surface, they have had applied to their exteriors a coating of 0.010 mm vapor deposited alumina according to the Johnson et al patent, and a cladding of metal, such as chemically deposited nickel to a thickness of 0.005–0.050 mm. Procedures for applying nickel coatings to ceramic particulates are commercially available and also are revealed in U.S. Pat. Nos. 3,920,410, 4,291,089 and 4,374,173. If the ceramic particulate material is inherently resistant to reaction with the matrix then the alumina coating would not be necessary.

Just before the particulates are laid on the surface of the blade tip, a coating of polymer adhesive which can be later vaporized at less than 540° C. is applied to the surface, to hold the particulates in place after they are deposited. We prefer 1–20 volume percent polystyrene in toluene. The particulates are laid on the surface by first attracting them to a perforated plate to which a vacuum is applied, and then positioning the plate over the surface and releasing the vacuum momentarily. It will be evident that other techniques and adhesives may be used to place the particulate.

Next the blade with the organically bonded particulates is heated while in a vertical position to a temperature of at least 1000° C., typically about 1080° C. for 2 hours, in a vacuum of about 0.06 Pa using a heat-up rate of about 500° C. per hour. Other inert atmospheres may be used. This step first volatilizes the polystyrene adhesive and then causes solid state bonding or sintering of the nickel cladding to the surface of the blade. The nature and location of the bond joint 34 as it is metallographically observable upon removal from the furnace is shown in FIG. 5. Owing to the irregular shape of the particulates and the thinnness of the metallic cladding on the particulates, the bond 34 is relatively delicate and located only at the points where particles 33 are very close to the surface 32. As will be appreciated, when the matrix is a superalloy it is not desirable to have a great deal of bond metal either around the particulate or bonding it to the substrate of the blade. It is also undesirable to expose the substrate to a temperature higher than about 1080° C. and therefore, the choice of cladding on the particulates is limited to materials which will produce a bond at such conditions. Furthermore, the cladding material must be one which is compatible with and which tends to interact with both the substrate and the subsequently applied matrix material. These limitations nonetheless allow for a variety of materials to be used. Preferably, nickel, cobalt or mixtures thereof are used. Alloying additions which are known to promote bonding may be also included. Generally, the basis metals of the cladding will tend to be those from the transition series of the periodic table when nickel, cobalt or iron base matrix and substrate alloys are involved. Under certain circumstances a coating may be applied to the surface 32 to enhance the desired adhesion.

Next, the particulates are oversprayed with a layer of matrix material deposited by plasma arc spraying to a thickness T of about 1.1–1.3 mm as shown in FIGS. 2 and 6. A nickel base superalloy as described generally above is used, such as that having the composition by weight percent 25 Cr, 8 W, 4 Ta, 6 Al, 1.0 Hf, 0.1 Y, 0.23 C, balance Ni.

The −400 U.S. Sieve Series Mesh powder is applied by argon-helium plasma arc spraying in a low pressure chamber. For example, commercially available equipment such as a 120 kw low pressure plasma arc spray system of Electro-Plasma Inc. (Irving, California, USA) may be used. See also U.S. Pat. No. 4,236,059. A blade is placed in the spray chamber which is evacuated to a pressure of 26 kPa or less. The oxygen level in the atmosphere is reduced to a level of 5 ppm by volume or less, such as by contacting the atmosphere in the chamber with a reactive metal. The workpiece blade is positioned with respect to the plasma arc device so that the tip cross section to be sprayed is normal to the axis along which the molten particulates travel. The blade is suitably masked around its periphery so that errant spray does not deposit on the sides of the blade.

Prior to initiating the actual deposition, the workpiece is simultaneously heated by the hot plasma arc gas to an elevated temperature of at least 700° C., typically 850° C., while being made cathodic with respect to a ground electrode located near to or as an integral part of the plasma arc device. A current of about 70 amperes is applied to a typical turbine blade tip for a period of about 2–10 minutes to aid in removing any oxide layers which may have accumulated on the part. The purpose of the heating process is to increase the receptivity of the part to the plasma arc spray and improve the bonding, as well as to decrease the residual stresses which are present after the workpiece, including the matrix metal and substrate, has cooled to room temperature. The abrasive will thus be made more resistive to cracking or spalling failure.

The metal matrix is applied to a thickness of 0.6–1.3 mm, preferably 1.1–1.3 mm as indicated. Preferably, the matrix material is deposited by a physical process in a thickness and quality such that the layer of metal is impenetrable to argon gas at elevated pressure, e.g., at least 130 MPa. This impermeability is attainable with the above described plasma spray process, provided sufficient thickness is applied. Although the layer will be impermeable it will nonetheless be characterized by some porosity as shown in FIG. 6. In particular, porosity 38 is present in the material above the surface of the particulates and there are voids 40 adjacent many of the particulates. The voids 40 are characteristic of the metal spraying process and would be produced by any "line of sight" deposition process, or one in which the deposited material physically travels in a straight line. Another process that may be used is a physical vapor deposition process. See U.S. Pat. No. 4,153,005 to Norton et al.

Next, the part is subjected to a densification, preferably by using hot isostatic pressing. Generally, this comprises deforming the abrasive material beyond its yield or creep-limit point at elevated temperature. Preferably, the part is subjected to 1065° C. and 138 MPa argon pressure while at elevated temperature, to close the aforementioned pores and voids. Other hot pressing procedures may be used to consolidate the matrix and achieve the object of densification and bonding. After the matrix is consolidated, the part is cooled in the furnace and removed.

But FIG. 7 shows in more detail how the abrasive appears in a metallographically prepared specimen. The superalloy matrix 36 is dense and fully envelops the particulates. And there is a region 42 surrounding each particulate 33, which region is deficient in chromium and aluminum and heavier elements, and rich in nickel, compared to the composition of the matrix material. This is of course a result of the nickel cladding layer which was applied to the particulate and as such it is a characteristic of the invention.

Next, the rough surface of the abrasive shown in FIG. 2 is machined using a conventional procedure such as grinding to produce the shape shown schematically in FIG. 3. The free surface 44 provides the desired z length dimension T′ which will characterize the finished blade. Next, the surface 44 of the blade is contacted with an etchant or other substance which will attack the matrix material, to thereby remove a portion of it. For example, electrochemical machining can be used, as is described in U.S. patent application Ser. No. 517,315 of Joslin, filed July 26, 1983.

As will be appreciated, the invention is comprised of particulates which are aligned along the article surface. Such a two-dimensional approach to fabrication produces an abrasive which is quite uniform and effective, compared to that resulting from the prior art three-dimensional approach which is embodied by mixing and consolidating particulate with metal powders. In the invention, the free machined abrasive surface is characterized by relatively uniform cross sectional areas of ceramics (reflecting the maximum to minimum particle sizes). This is contrasted with the widely varying areas reflecting the maximum to zero particle size which characterize the prior art powder metal abrasive. And when a portion of the matrix is partially removed, the presence of particulate material at the original free surface of the invention is unchanged. But in the prior art some of the particulates will be lost and the amount of free surface ceramic diminished, since portions of the particulates will have only been held in the abrasive by the matrix which is removed. In this respect a further advantage flows from the invention.

Although this invention has been shown and described with respect to a preferred embodiment, it will be understood by those skilled in the art that various changes in form and detail thereof may be made without departing from the spirit and scope of the claimed invention.

We claim:

1. An article comprised of a substrate to the surface of which is adhered an abrasive material comprised of metal matrix and a single layer of ceramic particulates contacting the substrate, the particulates surrounded by a thin metal cladding diffused with the matrix said metal cladding being of a differnt composition than said metal matrix, the preponderane of the ceramic particulates extending through the matrix from the substrate surface to a machined surface of the abrasive material.

2. The article of claim 1 characterized by ceramic particulates which are sized between No. 20 and No. 40 U.S. Sieve Series.

3. The article of claim 1 wherein 10–50 percent of the ceramic particulates protrude from the matrix.

4. The article of claim 1 characterized by the abrasive material having particulates substantially regularly spaced at 33–62 particulates per $cm^2$ of article surface.

5. The article of claim 4 having at least 42 particulates per $cm^2$.

6. An article shaped as a turbine engine airfoil having a curved tip surface to which is adhered an abrasive material comprised of a metal matrix surrounding ceramic particulates sized between No. 20 and No. 40 U.S. Sieve Series; there being about 33–62 particulates per square centimeter of tip surface substantially regularly spaced apart on the surface, less than about 15 percent of the particulates contacting one another; the preponderance of the particulates lying in a single layer, contacting the tip surface and extending with essentially equal lengths through the matrix to a machined surface of the abrasive, wherein about 10–50 percent of each ceramic particulate protrudes from the matrix.

7. The article of claim 6, having at least about 42 particulates per square centimeter.

8. An article made of superalloy and shaped as a turbine engine airfoil having a curved tip surface to which is adhered an abrasive material comprised of a high temperature alloy metal matrix surrounding ceramic particulates size between No. 20 and No. 40 U.S. Sieve Series; the preponderance of the particulates lying in a single layer; there being at least about 33 particulates per square centimeter of tip surface contacting the tip surface, less than about 15 percent of the particulates contacting one another and extending with essentially equal lengths through the matrix to a machined surface of the abrasive, the particulates characterized by an aspect ratio of less than 1.9 to 1, wherein about 10–50 percent of each particulate protrudes from the matrix.

9. The article of claim 8, having at least about 42 particulates per square centimeter.

10. The article of claim 6 or 8 characterized by ceramic particulates surrounded by a thin metal cladding diffused with a matrix metal of different composition.

11. The article of claim 10 characterized by less than 15 percent of the particulates contacting one another.

12. The article of claim 10 characterized by a matrix which is an oxidation resistant Fe, Co or Ni base alloy containing Cr and Al, wherein the matrix adjacent each particulate is relatively depleted in Cr and Al.

13. The article of claim 1, 6 or 8 wherein the machined surface of the abrasive material is characterized by machined ceramic particulates protruding partially from the matrix in essentially even amounts.

14. The article of claim 1, 6 or 8 characterized by a plasma sprayed superalloy matrix and silicon carbide particulates.

15. The article of claim 14 characterized by an abrasive material which by volume percent is made to be 10–20 silicon carbide, balance matrix, as measured when the matrix and particulates have the same thickness on a surface.

16. A gas turbine engine blade having a tip surface to which is adhered a layer of an abrasive material comprised of a plasma sprayed high temperature nickel base superalloy metal matrix which surrounds a single layer of abrasive silicon carbide particulates; wherein the particulates are sized between about No. 20 and No. 40 U.S. Sieve Series, and are coated with a thin layer of nickel, wherein each particulate contacts the tip surface and a portion of the nickel layer is diffused with the matrix and bonded to the tip surface, there being at least about 42 particulates per square centimeter of tip surface, regularly spaced apart thereon, less than about 15 percent of the particulates contacting one another; and wherein the surface of the metal matrix is machined and about 10–50 percent of each particulate extends through the surface of the matrix.

* * * * *

UNITED STATES PATENT AND TRADEMARK OFFICE

CERTIFICATE OF CORRECTION

PATENT NO. : 4,744,725

DATED : May 17, 1988

INVENTOR(S) : Alfred P. Matarese et al

It is certified that error appears in the above-identified patent and that said Letters Patent is hereby corrected as shown below:

Abstract, line 6: "normally" should be --nominally--

Column 10, line 34: "differnt" should be --different--

Column 10, line 35: "preponderane" should be --preponderance--

Signed and Sealed this

Eleventh Day of October, 1988

*Attest:*

DONALD J. QUIGG

*Attesting Officer*

*Commissioner of Patents and Trademarks*